United States Patent [19]

de Kremer et al.

[11] 4,119,318

[45] Oct. 10, 1978

[54] GOLF BALL FLIGHT INDICATING DEVICE

[75] Inventors: Mily de Kremer; Peter de Kremer, both of Poole, England

[73] Assignee: Dolcofin Ltd., Poole, England

[21] Appl. No.: 791,334

[22] Filed: Apr. 27, 1977

[51] Int. Cl.[2] ..... A63B 69/36

[52] U.S. Cl. ..... 273/185 C; 273/200 R

[58] Field of Search ..... 273/185 C, 184 B, 184 R, 273/185 R, 185 A, 185 B, 185 D, 186 R

[56] References Cited

U.S. PATENT DOCUMENTS

| | | | |
|---|---|---|---|
| 914,873 | 3/1909 | Peter | 273/185 C |
| 1,210,970 | 1/1917 | Nott | 273/184 B |
| 3,088,322 | 5/1963 | Marggraff | 273/185 C |

*Primary Examiner*—George J. Marlo

*Attorney, Agent, or Firm*—McNenny, Pearne, Gordon, Gail, Dickinson & Schiller

[57] ABSTRACT

A golf swing training device comprises a slide guide track and a slide mounted slidably along the track. The slide carries a friction engagement means which grip a portion of the slide guide track therebetween, to provide frictional resistance to the sliding movement of the slide. The slide has means for connection to a golf ball, striking the golf ball producing controlled sliding movement of the slide along the track.

7 Claims, 5 Drawing Figures

GOLF BALL FLIGHT INDICATING DEVICE

BACKGROUND OF THE INVENTION

To practice and perfect a golf swing, for achieving length and accuracy, it is essential to observe the nature of the flight of the golf ball when hit. Although this can be done in reality by going on to a golf course and hitting practice balls, the problem of recovering the balls can be tiresome, and it is also necessary not to inconvenience other players on the course. Alternatively, use can be made of a driving range, in which case the player wishing to practice his stroke hits a succession of golf balls onto the range. However, driving ranges of this nature usually require a substantial area of land and for this reason may be so located that they are not always easily accessible to a person wishing to use them.

SUMMARY OF THE INVENTION

An object of the invention is to provide a golf swing training device which employs a captive ball.

A further object of the invention is to provide a golf trainer which will provide an indication of the simulated length of a golf drive or stroke.

Yet a further object of the invention is to provide a golf training device which will also provide an indication of slicing or hooking of the drive or stroke.

A still further object of the invention is to provide a golf trainer which will provide a simulated flight of a struck golf ball, in a readily reproducible manner thereby to provide uniformity in the results provided by the device from one practice stroke to another.

According to the present invention, these and other objects are achieved by a golf swing training device which comprises a slide guide track and a slide slidable along the track. The slide is arranged to be connected to a captive golf ball by for example a flexible cord whereby, when the captive golf ball is struck, it will entrain the slide along the track. The slide also carries means which compress a portion of the track therebetween, to provide a frictional resistance to movement of the slide along the track when the ball is struck. The compression means may comprise plates which are urged towards each other by one or more preferably adjustable springs, with the said portion of the slide guide track being disposed therebetween and squeezed by the spring force, thus to provide the retarding force to movement of the slide. The slide may further carry an arrangement for moving the compression means away from each other, to release the spring force of the compression means on the slide guide track, so that the slide can be readily slid back to its starting position. The slide guide track advantageously comprises two guide members, each of a substantially L-shaped cross-section, with the plates gripping horizontal limb portions of the L-shapes. Alternatively, the slide guide track may comprise a bar of rectangular cross-section, with the plates disposed on respective sides of the bar, and the slide having portions which embrace the plates and the bar therebetween.

The slide guide track may be pivotally connected to the ground or to a suitable support surface or base, by a pivot connecting means disposed at the end of the slide guide track which is remote from the end towards which the slide is moved when the golf ball is struck. Pivotal movement of the slide guide track around the pivot connecting means will thus indicate slicing or hooking of the golf ball. The slide guide track may further have a calibrated scale, for indicating the simulated distance of travel of the struck golf ball.

DESCRIPTION OF THE PREFERRED EMBODIMENTS

Figure 1:
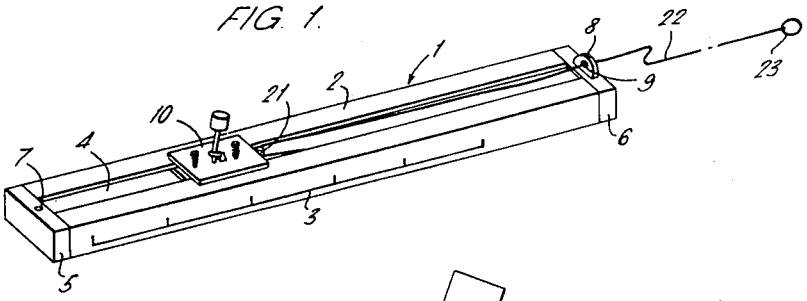
FIG. 1 shows a diagrammatic perspective view of a first embodiment of the device.

Referring firstly to FIG. 1, the first embodiment of the golf swing training device comprises a slide guide track indicated generally by reference numeral 1. The track 1 comprises two side guide members 2 and 3, each of which is for example of L-shaped cross-section, each L-shape being inverted and the horizontal limb portions of the L-shapes extending towards each other, from the upright limb portions of the L-shapes which extend vertically and parallel to each other. The free ends of the horizontal limb portions of each of the L-shapes terminate at a spacing from each other, to define a gap indicated at 4. A terminal member 5 and 6 respectively is fitted at each of the two ends of the slide guide members 2 and 3, to hold them together and at the required spacing.

The terminal member 5 has an aperture 7 extending perpendicularly to the longitudinal direction of the slide guide track, for receiving a pivot mounting pin, as will be described in greater detail hereinafter. The terminal member 6 carries a guide member 8 having an aperture 9 extending in the longitudinal direction of the slide guide track 1.

Figure 2:
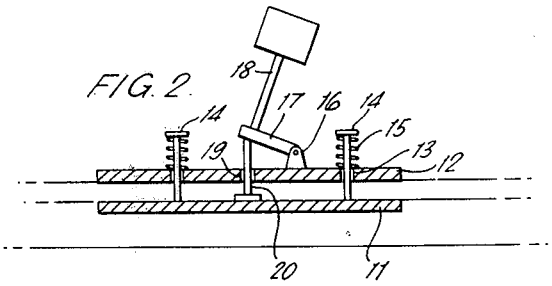
FIG. 2 shows a view in partial cross-section of the slide of the FIG. 1 embodiment, in the longitudinal direction of the slide.

The device also comprises a slide 10 which is displaceable by sliding along the track 1. Referring now also to FIG. 2, the slide 10 comprises a first plate 11 which is disposed below the horizontal limb portions of the two L-shapes of the side guide members 3. Disposed above the horizontal limb portions is a second plate 12. The two plates 11 and 12 thus extend parallel to each other, and across the gap 4.

The upper plate 12 has two apertures 13 through which pin members 14 extend so as to be freely movable therein. Each pin member 14 is secured, for example by screw-threading, to the lower plate 11. Each pin member 14 has a head (not referenced), while a compression spring 15 is disposed on each of the pin members 14, between the head of the respective pin member 14 and the plate 12. The two springs 15 therefore urge the plate 12 towards the plate 11. This means that the two plates will apply a compression or "squeezing" force to the horizontal limb portions of the two side guide members 2 and 3, thereby affording a resistance to sliding movement of the slide 10 along the slide guide track 1. The force of the two springs 15 can be made adjustable to vary the resistance to sliding movement of the slide member 10, for example, by screwing the pin members into the plate 11 to a greater or lesser extent, by making the heads on the pin members 14 adjustable along the pin members 14, or by providing for different strengths of compresion springs 15.

The upper plate 12 also carries a mounting bracket 16 which pivotally supports an actuating arm 17. Mounted adjacent the free end of the actuating arm 17 is a lever member 18. In line below the free end of the actuating lever 17, the plate 12 has an aperture 19 through which a pin member 20 passes so as to be freely displaceably in the aperture 19. The lower end in FIG. 2 of the pin member 20 has a head by means of which the pin member 20 bears against the plate 11, while the upper end of the pin member 20 bears against the free end of the actuating member 17. Thus, moving the lever 18 towards the left in FIG. 2, about the pivot mounting provided by the bracket 16, will cause the pin member 20 and thus the plate 11 to be displaced downwardly in FIG. 2, against the action of the springs 15, thereby releasing the two plates 11 and 12 from the side guide members 2 and 3, so that the resistance to the sliding movement of the slide 10 is removed.

Mounted at the end of the slide 10 which is towards the terminal member 6 is a roller 21, as can just be seen in FIG. 1. Around the roller 21 passes a cord 22, for example of nylon; the end of the lower run of the cord which extends at the bottom of the roller 21 is secured to a part of the slide guide track 1, for example the terminal member 6, while the other run of the cord 21 passes through the aperture 9, and is secured to a golf ball 23. The golf ball 23 can be secured to the cord 22 for example by driving a staple into the golf ball and then securing the cord to the staple. However, it has been found that the staple can cause substantial damage to the face of a club, according to the position in which the ball lies. Therefore, the cord can easily be secured to the golf ball by drilling a hole through the centre of the golf ball, passing the cord through the hole, and for example knotting the cord at its free end, to retain the golf ball on the cord by means of the knot.

A scale marking (not shown) can be provided on a suitable surface of the slide guide track 1, for example on one of the side surfaces of the side guide members 2 and 3, for indicating the simulated length of flight of a ball when using the device, as will be described below.

In use, the device can be secured to the ground by a pivot mounting pin passing through the aperture 7 in the terminal member 5. The golf ball 23 is set up on a tee directly in front of the terminal member 6. The slide 10 is set into its starting position, adjacent the terminal member 5. The golf ball 23 is then hit, and the displacement of the golf ball 23 causes a pulling force to be applied to the slide 10, entraining it along the slide guide track 1 towards the terminal member 6. However, this movement will be resisted by the force due to the squeezing of the side guide members 2 and 3 between the two plates 11 and 12, so that the slide 10 will be retarded by the resistance thus afforded. The distance by which the slide 10 is moved along the slide guide track 1 will therefore represent the force with which the golf ball 23 was struck. Suitable calibration of the scale marking on the slide guide track 1 will therefore make it possible to ascertain the distance over which the golf ball 23 would have travelled if it had been a free ball, that is to say, not attached to the slide 10. It may be found necessary for the scale marking to be progressive, in view of the dynamic conditions and forces acting on the ball 23 and the slide 10.

The device also makes it possible to ascertain whether the ball was for example sliced or hooked in its simulated flight. If in fact the ball is hit in a direction not precisely aligned with the direction of movement of the slide 10 along the slide guide track 1, the cord 22 will pull the slide guide track 1 into a modified position by pivoting about the pivot mounting pin in the aperture 7. The slide guide track 1 will therefore move to point in the direction in which the ball 23 would have flown if it had been free.

When then the slide 10 is to be moved back to the starting position, use is made of the actuating lever 18. By pulling the lever 18 towards the terminal member 5, the actuating lever 17 will be pivoted about the pivot of the bracket 16, thus releasing the force of the plates 11 and 12 on the horizontal limb portions of the side guide members 2 and 3. This will therefore enable the slide 10 to be easily moved along the slide guide track 1.

The side guide members 2 and 3 can comprise a light alloy, for example aluminium, while the plates 11 and 12 are preferably a plastics material, for example nylon, or are lined with a suitable friction material.

Figure 3:
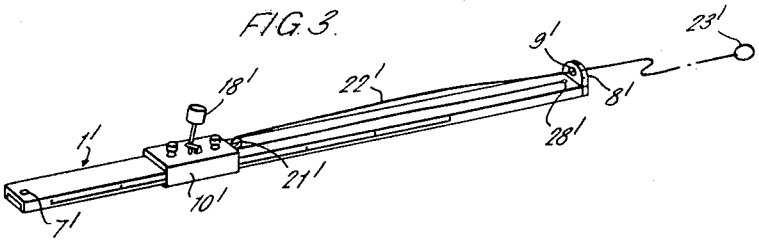
FIG. 3 shows a diagrammatic perspective view of the second embodiment of the device.
Figure 4:
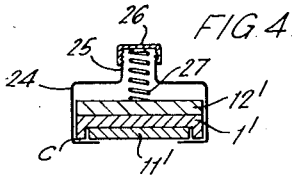
FIG. 4 shows a view in cross-section of the slide of the FIG. 3 embodiment, in the transverse direction of the slide.

Reference will now be made to FIGS. 3 and 4 which show the second embodiment of the device. This is of the same basic construction as the first embodiment described above, and comprises a slide guide member 1' along which a slide 10' is displaceable. The slide guide track 1' comprises a single member of generally flat channel-shaped cross-section, with an open part of the channel facing downwardly, as is clearly visible in FIG. 4. At one end the slide guide track 1 has an aperture 7' for receiving a pivot mounting pin, corresponding to the aperture 7 in FIG. 1, while the other end of the slide guide track has a guide member 8' with aperture 9'.

Referring now also to FIG. 4, the slide 10' comprises a first plate 11' which is disposed below the slide guide track 1', and a second plate 12' which is disposed above the slide guide track. The plate 11' lies in the downwardly open cavity or recess of the channel-shaped member. The slide 10' further comprises a carrier member diagrammatically shown generally at 24 in FIG. 4, which, as can be seen, is so shaped as to embrace the slide guide track 1', and the two plates 11' and 12'. It will be seen from FIG. 4 that the carrier 24 has side wall portions of such a dimension that there is a substantial clearance between the upwardly facing surface of the plate 12' and the downwardly facing surface of the horizontal portion of the carrier 24. It will also be seen that the thickness of the plate 11' is such that there is a clearance C between the downwardly facing end faces of the side limb portions of the channel-shaped member forming the slide guide track 1', and the adjacent horizontally extending portions of the carrier 24, which engage the plate 11'.

The carrier 24 also has two collar members 25 of which only one is visible in FIG. 4. At least an upper end portion of each of the collar members 25 is screw-threaded to receive a correspondingly screw-threaded cap member 26. The horizontal portion of the carrier 24 has an aperture aligned with the bore of each of the collar members 25, and a respective spring 27 is disposed within each of the collar members 25 and extends through the above-mentioned aperture in the carrier 24. One end of each spring 27 bears against the plate 12', while the other end of each spring bears against the respective cap member 26. The springs 27 will thus apply a compression force urging the cap members 26 in a direction away from the plate 12', and since the cap members 26 are connected to the carrier 24, the carrier 24 will thus urge the plate 11' against the slide guide track 1'. The slide guide track 1' is therefore compressed or squeezed between the plates 11' and 12', by the springs 27. The cap members 26 can be screwed on the collar members 25 to a greater or lesser extent, to adjust the compression force of the springs 27.

The slide member 10' also has a compression force-release arrangement indicated diagrammatically at 18', which is generally similar to the corresponding arrangement comprising components 16 to 20 on the slide 10 shown in detail in FIG. 2. Movement of the lever 18' towards the right in FIG. 3 will thus cause the plate 12' to be lifted upwardly (in FIG. 4) against the force of the springs 27, to release the slide 10' from the slide guide track 1'.

The slide 10' also carries a roller 21' for cord 22', one end being secured at an attachment point 28' and the other end to the golf ball 23'.

The second embodiment of the device is used in the same way as the embodiments of FIGS. 1 and 2.

Figure 5:
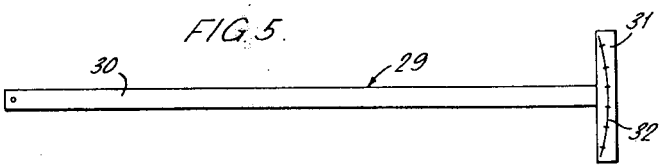
FIG. 5 shows a diagrammatic plan view of a mounting base member for supporting the slide guide track of either of the embodiments of FIGS. 1 and 2 or FIGS. 3 and 4.

In the case of both of the above-described embodiments of the device, instead of the pivot mounting pin for the guide track 1 being secured to the ground, the mounting pin can be secured to or can form part of a base member 29 as shown in FIG. 5. The base member comprises an elongate body portion 30 of such a length that when the mounting pin for the slide guide track 1 or 1' is connected to the base member 29, the other end of the slide guide track 1 or 1', being the end carrying the member 9 or 9', will lie adjacent a transverse member 31. The member 31 has an arcuate scale marking 32, for example in degress of deflection, whose radius of curvature substantially corresponds to the length of the slide guide track 1 or 1'.

The upwardly facing surface of the base member 29 is preferably such that the track 1 is freely slidable thereon, a suitable material for such surface being for example Formica (Trade Mark), although where the base member 29 is made of aluminium, the upwardly facing surface can simply be such metal.

When the device is used with the base member 29, the simulated length of flight of the ball 23 will be determined as previously. However, if the ball is sliced or hooked, the slide guide track 1 or 1' will be displaced relative to the base member 29, so that the pivotally moved end of the slide guide track will be displaced along the scale marking 32, thus indicating the angle of deviation of the simulated flight of the ball.

It is generally preferable to use the base member 29, since it is usually possible to use the slide guide track 1 or 1' without base member 29, only when the surface on which the slide guide track is placed is sufficiently smooth to allow the slide guide track to slide pivotally to indicate hooking or slicing.

Various other modifications can be made without departing from the scope of the invention, for example instead of each plate 11 or 11', 12 or 12' being in one piece, it would be possible to use a plate arrangement comprising a plurality of plate sections. Other spring arrangements for squeezing the portions of the slide guide track to provide the slide retarding force can also be envisaged, while similarly the compression force-release arrangement for facilitating the return movement of the slide could be changed, or possibly even omitted if desired. In the latter case, it would be desirable to provide a fixed handle on the slide member, for returning the slide to its starting position.

We claim:

1. A golf swing training device comprising an elongate guide member including an elongate rectilinear guide track portion which provides first and second mutually opposed flat guide surfaces on respective opposite sides thereof, a slide assembly mounted on the guide member and slidable along the length thereof, the slide assembly including first and second plate members each disposed on respective sides of the guide track portion and each providing a respective generally flat surface of substantial surface area, said flat surfaces facing towards each other and thereby being cooperable with respective ones of said first and second guide surfaces, the slide assembly further including spring means urging the first and second plate members towards each other whereby said flat surfaces thereof are pressed into frictional engagement with the adjacent first and second guide surfaces of said guide track portion, such engagement producing a force retarding sliding movement of the slide assembly in both directions along the guide member, the retarding force being substantially uniform along the length of the elongate member, and means for connecting the slide assembly to a golf ball, whereby when the ball is struck into flight the slide assembly is entrained by said connecting means along the guide members against said uniform retarding force.

2. A device as set forth in claim 1 including release means for moving said plate members away from the associated surfaces of the guide track portion, thereby to remove said retarding force.

3. A device as set forth in claim 1 wherein said guide surfaces of said guide track portion are formed by horizontal parts of two elongate elements which extend parallel to each other and which form said elongate member.

4. A device as set forth in claim 1 wherein said guide track portion comprises a bar of rectangular cross-section having opposed faces forming said guide surfaces, and wherein said slide assembly comprises a carrier, the plate members being disposed within the carrier and embracing the bar therebetween.

5. A device as set forth in claim 1 including means for pivotally connecting the device to a suitable support surface, the said pivotal connecting means being disposed at an end of the elongate guide member remote from the end towards which said slide assembly is moved when a golf ball connected to the slide assembly is struck, whereby pivotal movement of the guide member around said pivotal connecting means will indicate slicing or hooking of the struck golf ball.

6. A device as set forth in claim 1 further including a calilbrated scale on the guide member for indicating the distance of simulated travel of the struck golf ball connected to the slide assembly.

7. A device as set forth in claim 1, wherein said connecting means comprises a cord having a first end attached to the ball and a second end connected to an end of the elongate guide member towards which the slide assembly is moved when the ball is struck, and a roller rotatably mounted on the slide assembly with the cord passing around the roller.

* * * * *